United States Patent [19]

Neil

[11] Patent Number: 4,763,079

[45] Date of Patent: Aug. 9, 1988

[54] METHOD FOR DECELERATING PARTICLE BEAMS

[75] Inventor: George R. Neil, San Pedro, Calif.

[73] Assignee: TRW Inc., Redondo Beach, Calif.

[21] Appl. No.: 33,934

[22] Filed: Apr. 3, 1987

[51] Int. Cl.[4] ..... H05H 11/00

[52] U.S. Cl. ..... 328/233; 315/111.51

[58] Field of Search ..... 328/227, 233; 313/359.1; 315/111.51

[56] References Cited

U.S. PATENT DOCUMENTS

| | | | |
|---|---|---|---|
| 3,916,246 | 10/1975 | Preist | 328/227 X |
| 4,085,376 | 4/1978 | Abramyan et al. | 328/233 |
| 4,396,867 | 8/1983 | Turchi et al. | 328/227 X |

*Primary Examiner*—David K. Moore
*Assistant Examiner*—Sandra L. O'Shea
*Attorney, Agent, or Firm*—Noel F. Heal; Thomas N. Giaccherini

[57] ABSTRACT

A method for decelerating beams of charged particles that have been accelerated using a linear accelerator. The high-energy particles, such as electrons, are passed through a series of induction cells, each of which generates an electrical pulse as a packet of electrons passes through it and has its velocity reduced. The energy removed from the packets of electrons in the form of electrical pulses can either be stored for later use or discharge, or can be immediately employed to accelerate other electrons in an associated linear accelerator.

10 Claims, 1 Drawing Sheet

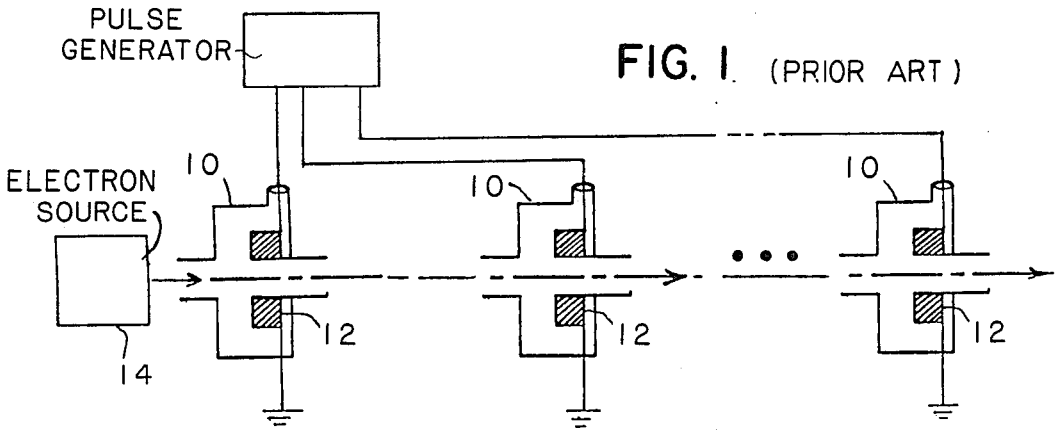
FIG. 1 (PRIOR ART)
FIG. 2
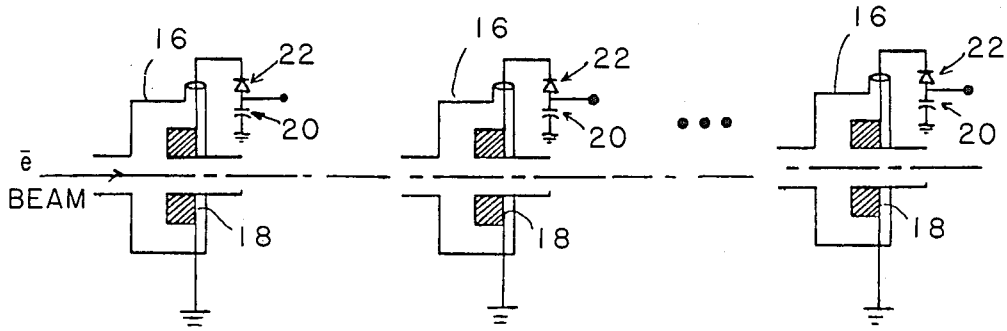
FIG. 3
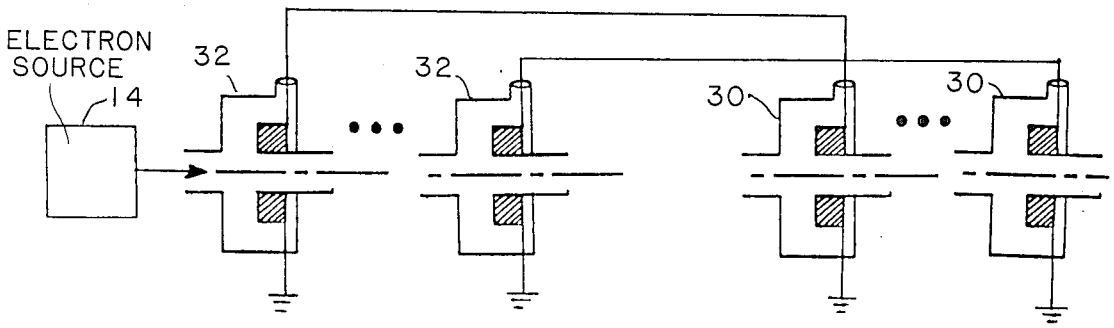

METHOD FOR DECELERATING PARTICLE BEAMS

BACKGROUND OF THE INVENTION

This invention relates generally to linear accelerators and, more particularly, to applications of induction-type linear accelerators that generate beams of charged particles, such as electrons, of very high energies. There are basically two types of linear accelerators, one employing radio-frequency (rf) energy to accelerate electrons or other particles, and the other operating on an induction principle. In accelerators of the induction type, electrons are accelerated by means of a series of induction cores through which they are passed. When each core is activated with a large electrical pulse, it functions in the manner of a transformer, inducing current flow in its "secondary winding," which is the stream of electrons passing along the axis of the core. A beam of electrons, or more precisely a stream of packets of electrons, is accelerated in each of a series of such cores, until the electrons reach a desired energy or velocity level.

The high-speed electrons are put to a variety of uses, such as in the analysis of subatomic particles, in free-electron lasers, or in the irradiation of food. In many cases, however, the accelerated electrons still have a very high energy after they have been put to use. Typically, the remaining high-speed electrons are "dumped" into an absorbent material, such as graphite. Although this approach has been satisfactory for most purposes, in recent years there has been a requirement for electrons of higher and higher energies, and dumping of extremely high-energy electrons has the important disadvantage that the absorbent material employed will become significantly radioactive. Appropriate handling and treatment related to radioactive substances will be needed in these cases.

Accordingly, there is a need for a different approach to the handling of high-energy electrons or other charged particles produced in an induction linear accelerator. The present invention satisfies this need.

SUMMARY OF THE INVENTION

The present invention resides in a method for decelerating electrons or other charged particles that have been accelerated in a linear accelerator. Briefly, and in general terms, the invention comprises the steps of passing each packet of charged particles through at least one induction core positioned in the path of the particles, generating an electrical current pulse as each packet of particles passes through the induction core, and simultaneously decelerating each packet of particles as it passes through the induction core.

In a preferred embodiment of the invention, the method also includes the step of passing each packet of particles through additional induction cores positioned in a series string to provide progressive deceleration to the particles. In one application of the invention, the method further includes the step of storing the energy of each pulse generated in the induction cores in electrical storage means. In some applications of the invention, it may be advantageous to employ the energy generated in the induction cores to accelerate other charged particles in a linear accelerator. For extremely high electron energies, the cost of the energy to accelerate the electrons is a significant design factor. In accordance with the method of the invention, the energy of the electrons or other charged particles can be effectively recovered by decelerating them with induction cores, and employing the derived energy to accelerate other packets of particles in an accelerator.

It will be appreciated from the foregoing that the present invention represents a significant advance in the field of linear accelerators. In particular, the invention provides a technique for decelerating charged particles and at the same time recovering the potential energy stored in the particles, for subsequent use or for concurrent use in accelerating other particles. Thus the invention not only reduces the energies of the particles to a level at which they may be safely disposed of, but at the same time recovers the energy that was used to accelerate the particles. Other aspects and advantages of the invention will become apparent from the following more detailed description, taken in conjunction with the accompanying drawings.

BRIEF DESCRIPTION OF THE DRAWINGS

FIG. 1 is a simplified block diagram of a linear accelerator of the induction type;

FIG. 2 is a simplified block diagram of the particle decelerating apparatus used in practicing the method of the invention; and FIG. 3 is a simplified block diagram showing how energy recovered from high-speed charged particles can be immediately employed to accelerate other packets of particles.

DESCRIPTION OF THE PREFERRED EMBODIMENT

As shown in the drawings for purposes of illustration, the present invention is concerned with techniques for decelerating beams of charged particles, such as electrons. The use of greatly increased electron energies in linear accelerators, particularly of the induction type has posed the need for some way of disposing of the the resultant high-energy electrons. Dumping electrons into an absorbent material is not only wasteful of energy but poses a significant hazard because of the resultant radioactivity.

In accordance with the invention, high-energy charged particles are decelerated using the reverse of the process by which they were accelerated, and utilizing a cell similar to the one used to accelerate particles in an accelerator of the induction type. More specifically, electrons are decelerated as they pass through a series of induction linear accelerator cells, and the energy of the electrons is converted back into electrical energy.

FIG. 1 shows a typical arrangement for accelerating electrons using the linear induction principle. The accelerator includes a series of induction cells, indicated by reference numeral 10, each of which has a cylindrical induction core 12 that forms the primary winding of a transformer. A source of electrons 14 directs electrons into the first of the cells 10, and an electrical pulse is simultaneously applied to the core 12. The "secondary" of the transformer is the electrical current formed by the flow of electrons along the axis of the cylindrical core 12. When the pulse is applied to the core, the electrons are accelerated in the axial direction and proceed to the next of the cells 10. A similar pulse is applied to the next cell's core, and the electrons are further accelerated along the common axis of the cells 10. Because of the pulsed nature of this operation, the electrons generated are in the form of a pulses or "packets" of particles, the length and spacing of which depend on the various timing parameters associated with the accelerator.

In the method of the invention, the electrons are decelerated by almost identical apparatus, as shown in FIG. 2, including a series of induction cells 16 disposed in the path of the high-energy electrons. In the decelerating action of one of the cells 16, the induction core 18 is not pulsed by an external source, but rather generates an electrical pulse as a packet of electrons passes along its axis. The "primary" and "secondary" roles in the induction action are reversed as compared with the accelerator, the electrons being the primary and the core being the secondary. As a result of the induction action of the cell 16, the velocity of the electrons is reduced and an electrical pulse is generated across the induction core 18. In accordance with one aspect of the invention, the pulse is stored in a capacitor 20 connected across the core 18 and may be later discharged or used for some other purpose. A diode 22 connected between the core 18 and the capacitor 20 prevents the capacitor from discharging back into the core.

In accordance with another aspect of the invention, the energy generated in decelerating a packet of high-energy electrons is immediately employed to accelerate electrons in an accelerator of the same type. This is shown diagrammatically in FIG. 3, in which a decelerating cell 30 is connected directly to an accelerating cell 32. In many applications, such as in a laboratory setting, it is necessary to generate many packets of accelerated electrons. In these cases, the decelerating electron packets can be usefully employed to generate energy for accelerating subsequent packets. There will, of course, be resistive losses in such an arrangement, and some energy will still have to be supplied to the accelerating cell from an external source. However, the savings in energy are significant.

It will be appreciated from the foregoing that the present invention represents a significant advance in the field of particle accelerators of the induction type. In particular, the invention provides a method for decelerating high-energy charged particles without any further consumption of energy and without having to absorb the energy of the particles in a material that may become radioactive as a result. In the method of the invention, a substantial portion of the energy of the electrons is recovered and may be stored or reused to accelerate other packets of electrons.

It will also be appreciated that, although an embodiment of the invention has been described in detail for purposes of illustration, various modifications may be made without departing from the spirit and scope of the invention. Accordingly, the invention is not to be limited except as by the appended claims.

I claim:

1. A method for decelerating packets of charged particles that have been accelerated in a linear accelerator, the method comprising the steps of:

passing each packet of charged particles through at least one induction core positioned in the path of the charged particles;

generating an electrical current pulse as each packet of charged particles passes through the induction core; and simultaneously decelerating the each packet of charged particles as it passes through the induction core.

2. A method as defined in claim 1, wherein the method further comprises the step of:

passing each packet of charged particles through additional induction cores positioned in a series string to provide progressive deceleration of the charged particles.

3. A method as defined in claim 1, and further including the step of:

storing the energy of each pulse generated in the induction cores in electrical storage means.

4. A method as defined in claim 1, and further comprising the step of:

employing energy generated as a result of the generating step to accelerate charged particles.

5. A method as defined in claim 2, and further comprising the step of:

employing energy generated as a result of the generating step to accelerate charged particles.

6. A method as defined in claim 1, wherein:

the charged particles are electrons.

7. A method as defined in claim 2, wherein:

the charged particles are electrons.

8. A method as defined in claim 3, wherein:

the charged particles are electrons.

9. A method as defined in claim 4, wherein:

the charged particles are electrons.

10. A method as defined in claim 5, wherein:

the charged particles are electrons.

* * * * *